United States Patent [19]

Gerber

[11] 4,060,016

[45] Nov. 29, 1977

[54] METHOD AND APPARATUS FOR BLANKING OUT PATTERN PIECES FROM A LAYUP

[75] Inventor: Heinz Joseph Gerber, West Hartford, Conn.

[73] Assignee: Gerber Garment Technology, Inc., East Hartford, Conn.

[21] Appl. No.: 708,700

[22] Filed: July 26, 1976

[51] Int. Cl.[2] ..... B26F 1/40; D06H 7/00

[52] U.S. Cl. ..... 83/451; 83/552; 83/562; 83/925 CC

[58] Field of Search ..... 83/374, 451, 552, 561, 83/562, 925 CC

[56] References Cited

U.S. PATENT DOCUMENTS

| | | | |
|---|---|---|---|
| 291,559 | 1/1884 | Williams | 83/451 |
| 1,298,806 | 4/1919 | Skrzynecki | 83/552 |
| 3,357,288 | 12/1967 | Goodman et al. | 83/562 X |
| 3,477,322 | 11/1969 | Gerber et al. | 83/451 X |
| 3,555,949 | 1/1971 | Treff | 83/561 X |
| 3,598,006 | 8/1971 | Gerber | 83/451 X |
| 3,835,747 | 9/1974 | Bystrom | 83/451 X |

*Primary Examiner*—J. M. Meister

*Attorney, Agent, or Firm*—McCormick, Paulding & Huber

[57] ABSTRACT

A relatively rigid horizontally extending supporting surface supports a layup of sheet material to be cut. Air is evacuated from between the sheets in the layup, and a sheet of air impervious material covers the layup to aid in compacting the layup. One of several blanking dies in a turret is adapted for vertical movement in a carriage mechanism, which is movable in at least one coordinate direction across the layup. Relative movement in the other coordinate direction is also provided for, and the turret is rotatable on a vertical axis normal to the supporting surface for orienting the die to be used. The blanking die turret is also indexable about a horizontal axis in order to locate its various dies for the blanking motion and thereby minimize waste from the layup of sheet material.

10 Claims, 7 Drawing Figures

FIG. 1
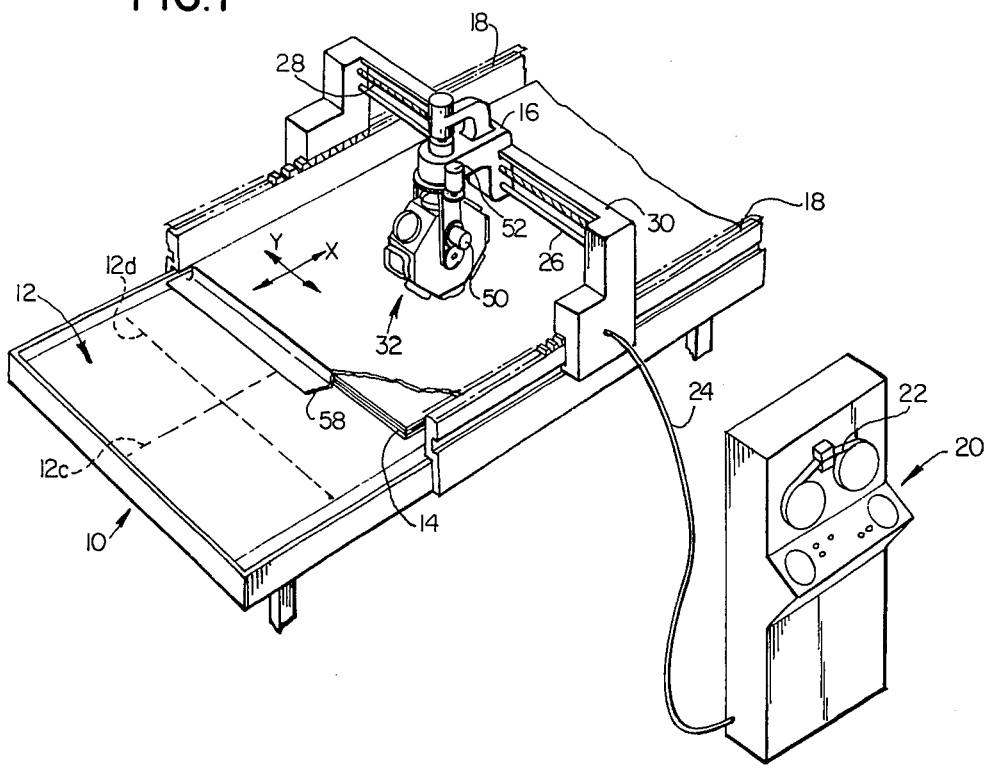
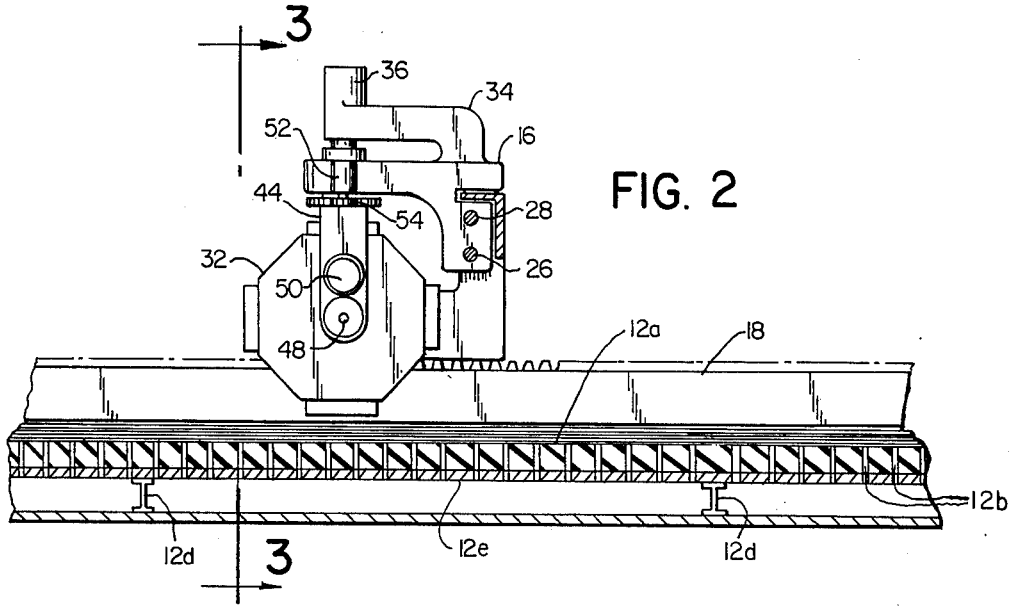
FIG. 2

METHOD AND APPARATUS FOR BLANKING OUT PATTERN PIECES FROM A LAYUP

SUMMARY OF THE INVENTION

This invention relates generally to means for working on sheet material provided in a layup form, and deals more particularly with an improved method and apparatus for blanking out pattern pieces from such a layup of sheet material as used for example, in the garment and upholstery fabric industries.

The general aim of the present invention is to provide an improved method and apparatus which is particularly well suited for use with automatically controlled work tools wherein a blanking die blanks pattern pieces from a compacted layup to minimize waste material.

In accordance with the presently preferred apparatus of the invention, a layup of sheet material is spread on a supporting surface, which surface is preferably rigid enough to react the force of the blanking die. The layup is compacted by evacuating air from between the layup sheets, and a sheet of air impervious material may be spread over the layup to facilitate the withdrawal of air through the supporting surface or to the sides of the layup by the application of vacuum. The uppermost sheet in the layup, or the air impervious sheet, will be pulled toward the supporting surface and thereby hold the layup in a relatively rigid or firm condition suitable for being cut in a blanking operation by means of an automatically operated blanking die. The vacuum may be selectively applied, in the vicinity of the blanking die, and suitable means may be provided for reducing the pressure losses as a result of blanking out stacks on the layup, such as the application of endless belts of air impermeable material provided to one or both sides of the blanking die. Several blanking dies are provided on the various faces of an indexable turret, rotated on a horizontal axis, to position the desired blanking die for blanking movement, and the turret is provided in a carriage mechanism, movable in at least one coordinate direction. Relative movement in the other coordinate direction is also provided for in order to facilitate coverage by the blanking die, or dies, across the entire expanse of the layup. The turret is also indexable on a vertical axis normal to the supporting surface in order to orient the die in the plane defined by these coordinate directions.

The chief aim of the present invention is to secure various layers of sheet material in a layup so that the sheets are prevented from shifting or otherwise moving relative to one another by means of the pressure differential created between the top and bottom of the stack. A steel rule blanking die is adapted to cut through the layup and to form a stack of pattern pieces in a single blanking operation such that waste is minimized. Further, the blanking die is operated in both coordinate directions and angularly about an axis normal to the surface. Also any one of several blanking dies can be indexed in position for the blanking operation, and all of these variables are operated under the control of a computerized system which is programmed so that the carriages traverse the bed, and so that pattern pieces are blanked out of the layup in an automated mode of operation.

BRIEF DESCRIPTION OF THE DRAWINGS

FIG. 1 is a perspective view, with portions broken away, of an apparatus constructed in accordance with the present invention.

FIG. 2 is a vertical sectional view taken longitudinally of FIG. 1.

DETAILED DESCRIPTION

Figure 3:
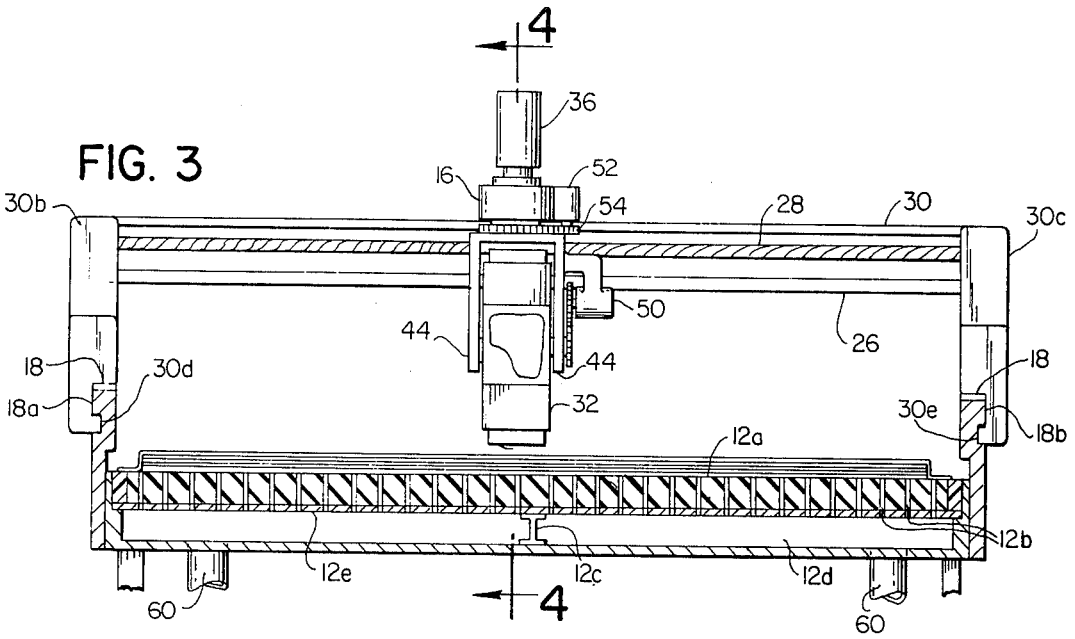
FIG. 3 is a sectional view taken generally on the line 3—3 of FIG. 2.

Turning now to the drawings in greater detail, an apparatus for blanking out pattern pieces from a layup of sheet material is shown in FIG. 1 and includes a table, or bed indicated generally at 10, providing an upwardly facing supporting surface 12 adapted to support a plurality of fabric sheets arranged in vertically stacked relationship as best shown at 14. A carriage mechanism 16 is supported above the table for traversing said surface thereof in mutually perpendicular coordinate directions, as indicated by the arrows X and Y. A computer 20 provides programmed information from a memory in the form of a tape 22, and develops control signals in accordance with this information, which signals are in turn transmitted to suitable devices, such as a drive motor or the like (not shown) through a control cable 24, in order to achieve movement of a cross carriage 30 in the X direction, and the carriage mechanism 16 in the Y direction on said cross carriage 30.

The carriage 16 is slidably mounted on a guide bar 26 and on a guide member defined in the cross carriage 30 for movement thereof in the direction in response to rotation of a lead screw 28. The guide bar 26, the guide member 30*a* and the lead screw 28 are provided in the cross carriage 30, which carriage 30 is adapted for movement on the racks 18,18 extending longitudinally of the table 10. One or more drive motors (not shown) are provided in the cross carriage 30 for movement thereof in the X direction. These drive motors are operated to achieve X and Y coordinate motion of the carriage 16 in response to commands from the computer 20.

As best shown in FIG. 3, the cross carriage 30 has end portions 30*b* and 30*c* which support the angular beam 30*a*, and these end portions house the drive motors for achieving movement of the cross carriage 30 in the X coordinate direction. Additionally, these end portions 30*b* and 30*c* are restrained against vertical movement with respect to the fixed rails 18,18 and the bed 10 by cooperating flanged portions 30*d* and 30*e* on the cross carriage end portions and the flanges 18*a* and 18*b* on the rails 18,18. Although the cross carriage 30 is shown in FIG. 1 as being movable relative to the fixed bed 10, it will be apparent that this carriage 30 might be fixed, and the layup 14 provided on a conveyor for movement in the X direction. The important consideration here is that relative motion be provided for between the blanking die and the supporting surface upon which the sheets are layed up.

A plurality of blanking dies are provided in a turret 32 mounted in the carriage mechanism 16 and the turret is adapted for blanking movement normally relative to the bed or table 10 in order to blank stacks of pattern pieces from the layup of sheet material 14. Preferably, a plurality of faces are provided in the turret 32 and dies of different shape are mounted to these faces. Means is provided for moving the turret vertically in order to achieve the blanking motion required to blank out stacks of pattern pieces from the layup of sheet material 14, and preferably said means comprises an upstanding bracket 34, best shown in FIG. 4, mounted to the carriage 16 and having a fluid motor, or actuator 36, with one part 38 fixed to the bracket 34, and a movable part in the form of the piston 40 connected to the turret structure 32 by a shaft means 42 such that vertical movement of the piston 40 will cause blanking movement of turret 32, and of the lower most die 46, in order to blank out stacks of pattern pieces from the layup 14. The motor 36 also provides for return movement of the die 46, the piston 40 being shown in its raised position in FIG. 4. As best shown in FIG. 2 depending arms 44,44 are provided on the shaft structure 42 so as to support the turret 32 in order to achieve this vertical motion of its blanking die 46. In addition, the turret 32 is supported for indexable movement about the horizontal axis of shaft structure 42 such that any one of the plurality of blanking dies provided in the turret can be oriented in the active position shown for the lowermost die 46 in order to achieve the vertical movement of each of the blanking dies in the blanking movement required. A stepping motor 50 is provided on the arm 44 and is operated under the control of the computer 20 for achieving this indexing movement of the turret.

Figure 4:
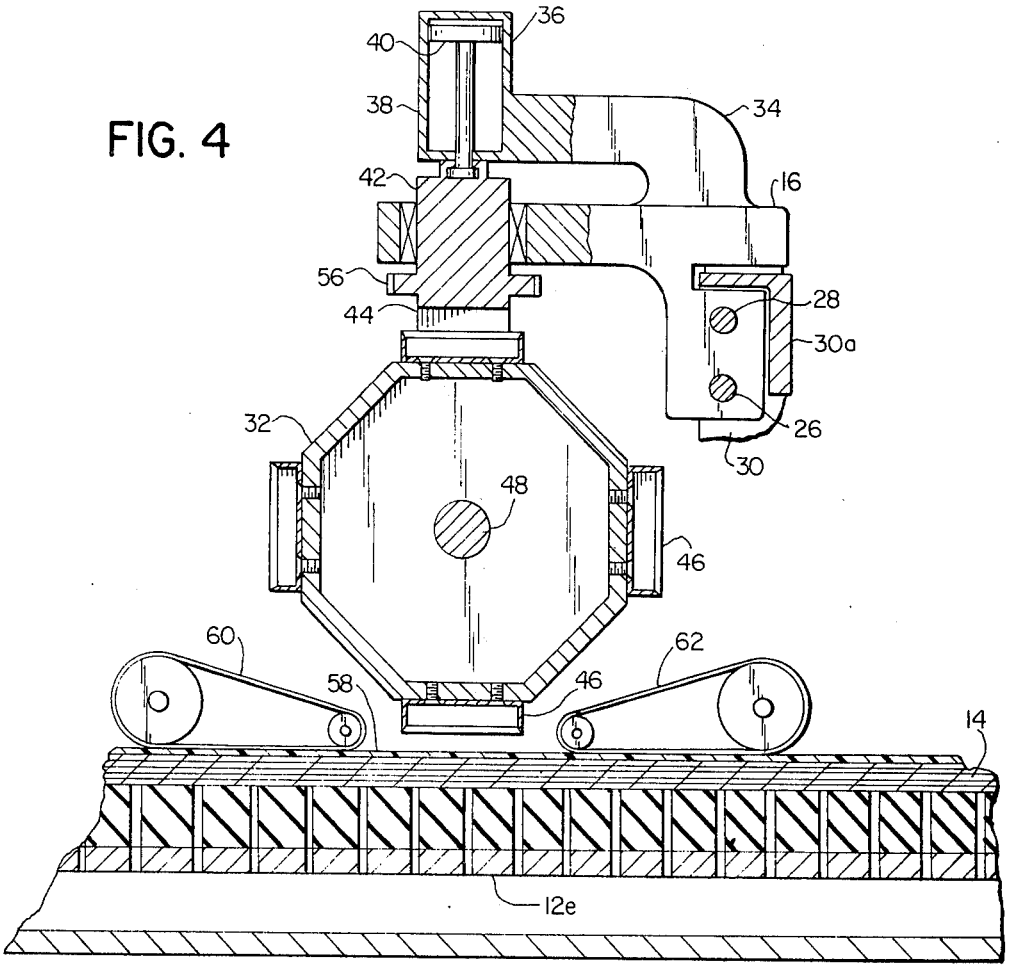
FIG. 4 is a sectional view taken generally on the line 4—4 of FIG. 3, and also shows a device for assisting the vacuum holddown system of FIG. 3.

Means is also provided for rotating the turret structure on its vertical axis, that is about the axis of the shaft structure 42, that is normally with respect to the plane of the supporting surface of the layup 14, and preferably said means comprises stepping motor 52 mounted to the carriage mechanism 16 as shown in FIGS. 1 and 2. Said stepping motor 52 has an associated output shaft adapted to drive a small gear 54, which gear is adapted to mesh with a larger gear 56 provided for this purpose on the shaft means 42 as best shown in FIG. 4. The shaft means 42 is fixed to the turret 32 at its lower end, and has a rotary connection at its upper end for connection with piston rod associated with the actuator piston 40. Thus, limited angular rotation of the stepping motor 52 will achieve a reorientation of the blanking die 46 provided at the lowermost side of the turret 32, also under the control of the computer 20, and this re-orientation can be achieved without interrupting the basic blanking motion achieved by the actuator 36.

Turning next to a more complete description of the table or bed 10, this component of the apparatus may include a series of contiguous vacuum chambers defined below the structure for supporting the layup of sheet material, and the reader is referred to my prior U.S. Pat. Nos. 3,495,492 and 3,598,006 issued May 5, 1969 and Aug. 10, 1971 respectively, for a more complete description of such a vacuum holddown system. Such a system utilizes vacuum for holding a layup of sheet material on a supporting surface in order to facilitate cutting of the layup while the layup is held in a compacted condition. A vacuum chamber is provided below the supporting surface in order to facilitate the application of a vacuum through openings **12*b*, 12*b* in the supporting surface and a sheet or panel of substantially air impervious material, such as polyethylene, is spread over the upper surface of the layup and cooperates with the vacuum to draw the sheets toward the supporting surface and thereby compact the layup of sheet material therebetween. The air impervious panel or sheet may be expendable being spread entirely over the surface of the layup prior to the operation of the apparatus, and endless belts of similar holddown assist devices may be located in front of and/or behind the die as it is performing its blanking function. FIG. 4 shows schematically a pair of endless belts 60 and 62 of the type which might be utilized ahead of and behind the turret as the carriage 30 moves in the X direction in order to facilitate holding the layup of sheet material in a compacted condition even after a portion thereof has been blanked with the result that the air impervious panel or sheet 58 will have been punctured and severed in a plurality of places thereby upsetting the effects of the vacuum provided below the table 10. These belts are entrained over rollers which are rotatably mounted in the carriage 30**, and these belts may be driven by reason of the carriage movement itself.

As mentioned, the bed 10 may be divided into various zones, each of which is independently controlled from a common source of vacuum by suitable valves (not shown) of the type described in the above-mentioned U.S. Pat. Nos. 3,495,492 and No. 3,598,006.

Still with reference to the bed or table 10, defining the supporting surface for the layup of sheet material, it is important that the upwardly facing supporting surface is mechanically rigid, and the material used preferably comprise a resilient rubber, or neoprene, or other elastomeric substance capable of withstanding the rather large forces imposed thereupon by the blanking die. Unlike the action of a reciprocable cutter of the type described in my above-mentioned patents, the blanking die requires a relatively rigid supporting surface suitable for reacting the forces exerted upon it by the steel rule die. Thus, the supporting surface preferably has openings provided therethrough in order to facilitate the formation of the vacuum beneath the layer of air impervious polyethylene 58, and these openings may be drilled by suitable means without interfering with the necessary strength of the bed or table. Structure is provided below the supporting surface in order to withdraw air from beneath the polyethylene, and through these openings, to evacuate the air from between the layers of sheet material in the layup in order to compact the layer and prevent it from shifting laterally during the blanking operation. Preferably, such structure for supporting the rubber or neoprene air-permeable mat comprises a steel plate **12*e* itself provided with drilled openings aligned with those in the rubber or neoprene mat 12. The said plate 12*e* is in turn supported by a central longitudinal stringer 12*c* and by the longitudinally spaced separators 12*d*, 12*d*. Means is provided for selectively applying vacuum pressure to the chambers defined by these separators 12*d*, 12*d* and the stringer 12*c* as taught in my above-mentioned patents, and as suggested by the ducts 60,60**.

In the foregoing description of FIGS. 1–4, inclusively, the general method and apparatus of the present invention is described with reference to a layup of sheet material covered by an air impermeable sheet, and means for withdrawing air from the layup wherein this air is illustrated as drawn downwardly through the sheets in the layup. Such a situation will be practical only if the sheets in the layup are themselves permeable. It the layup sheets are not air permeable, as for example, if the sheets to be blanked are or vinyl or other impermeable plastic or rubber material, it will be apparent that the vacuum will be much less effective in holding the layup in a compacted condition so that it acts like a solid block and so that the die will cut uniformly shaped pieces from each sheet in the layup. When such sheets are blanked, the uppermost sheets will tend to move relative to the lower ones, and as a result, the uppermost pieces will tend to be either smaller or larger than the lower ones depending on the degree of compression caused by the die itself (see FIG. 6) and on the degree of slippage between the sheets in the layup. This result will be especially noticeable in blanking pattern pieces from a urethane foam backed vinyl sheet material, and FIG. 5 shows a very effective solution to this problem.

Figure 5:
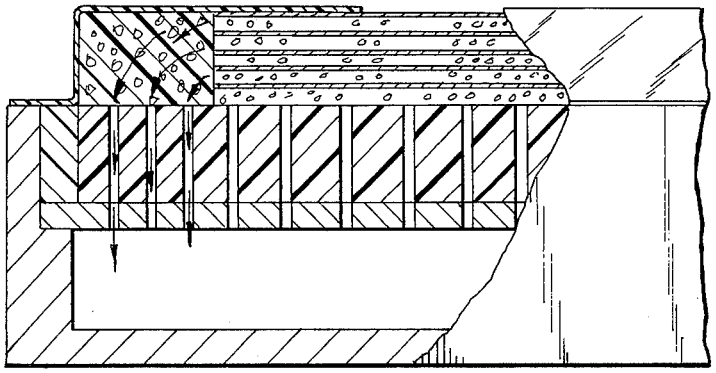
FIG. 5 is a sectional view of an alternative embodiment, being taken to a larger scale than FIG. 3 but illustrating one marginal edge of such alternative embodiment from substantially the same vantage point as FIG. 3.
Figure 6:
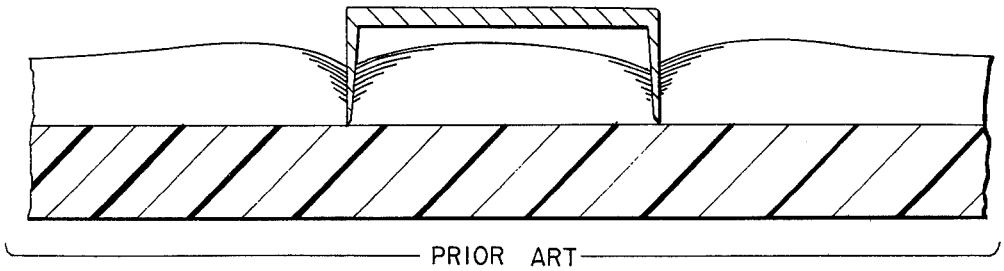
FIG. 6 is a view illustrating the relative movement encountered in the prior art approach to blanking stacked sheets of material without evacuating the air from between the layers.
Figure 7:
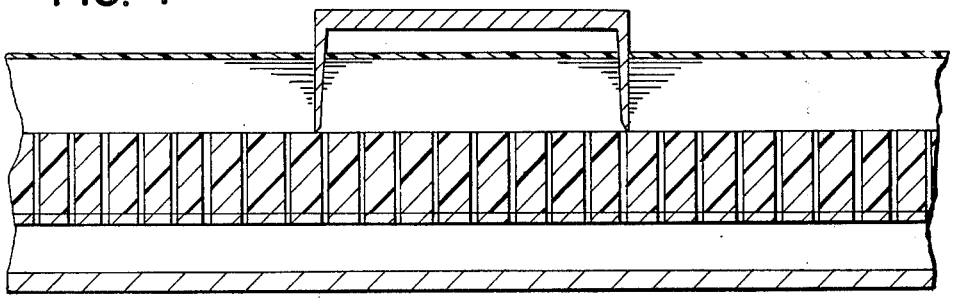
FIG. 7 is a view illustrating the effect achieved as a result of compacting the layup prior to the blanking step.

The sheets 5,5 in FIG. 5 may comprise an outer skin of air impervious plastic material, such as vinyl for example, and may include a backing of air pervious foam material, such as polyurethane foam. As shown in FIG. 5, the air from between adjacent sheets can be withdrawn laterally through the foam material by providing longitudinally extending blocks marginally of the layup. These blocks are relatively noncompressible but are air permeable (as described in issued U.S. Pat. No. 3,777,604) so that they provide a path for the air to be withdrawn from between the layed up sheets. The mat 12 may be similar to that described hereinabove with reference to FIGS. 1–4, or may be air permeable only along its marginal edges below the blocks.

Where the sheets 5,5 comprise only air impervious plastic sheets the same results can be achieved by interleaving such sheets with layers of non-compressible material such as corrugated cardboard or the like, as also shown and described in the abovementioned U.S. Pat. No. 3,777,604.

In both the situations, enumerated hereinabove, the need for the polyethelene sheet 58 to cover the entire upper surface of the layup is not present, and as long as such an air impermeable sheet covers at least the marginal edges of the layup, and the air permeable blocks, the necessary results can be achieved, namely the air can be withdrawn from between adjacent sheets in the layup under the uppermost sheet (which is always air impermeable). Thus, the uppermost sheet in the layup to be blanked will be either a covering sheet 58 disposed over at least that portion of the layup which is evacuated, or will comprise marginal segments overlying the porous blocks and the marginal edges of the layup where the sheets to be blanked are themselves are air impermeable.

I claim:

1. Apparatus for blanking pattern pieces out of a layup of sheet material and comprising:

a. means defining a substantially continuous upwardly facing supporting surface for the sheet layup, said supporting surface being mechanically rigid, b. means for withdrawing the air from between adjacent sheets in said layup to provide a compacted layup on said supporting surface, c. a turret having a plurality of faces, and means rotatably supporting said turret for indexing movement on a turret axis, d. a plurality of blanking dies provided on said turret faces, e. means for moving said turret and said turret axis normally relative to said sheet layup supporting surface to move one of said blanking dies through the layup to blank pattern pieces out of said layup, said supporting surface being rigid enough to react the forces imposed thereon by said blanking die as it cuts through the layup and contacts said supporting surface.

2. Apparatus according to claim 1 and further characterized by means for moving said turret and turret axis relative to said supporting surface in at least two coordinate directions parallel to the plane defined by said supporting surface for blanking pattern pieces from different areas of the layup.

3. Apparatus according to claim 1 further characterized by means for rotating said turret and turret axis about an axis normal to the plane defined by said supporting surface for angularly orienting said blanking die to permit blanking pattern pieces from the layup in a variety of orientations.

4. Apparatus according to claim 2 and further chracterized by means for rotating said turret and turret axis about an axis normal to the plane defined by said supporting surface for angularly orienting said blanking die to permit blanking pattern pieces from the layup in a variety of orientations.

5. Apparatus according to claim 4 further characterized by means for removably mounting each of said blanking dies to each of said turret faces.

6. Apparatus according to claim 1 wherein said mechanically rigid layup supporting surface comprises an air-permeable bed of elastomeric material, said bed having a plurality of through openings extending therethrough and said supporting surface comprising the flat planar upper surface of said bed, and means defining a chamber below said bed communicating with a vacuum source to permit withdrawal of the air from the layup as aforesaid.

7. Apparatus according to claim 1 further characterized by an air-impermeable sheet disposed over at least the marginal side edges of the layup of sheet material to be blanked.

8. Apparatus according to claim 1 further characterized by blocks of air-permeable material alongside the marginal side edges of said layup, and on said supporting surface, and an air-impermeable sheet disposed over at least the marginal side edges of the layup and over said air-permeable blocks to provide a path for air withdrawn from between the layed up sheets.

9. Apparatus according to claim 1 further characterized by an air-impermeable sheet disposed over all of the upwardly facing surfaces of said layup.

10. Apparatus according to claim 1 further characterized by said sheets of said layup being air-permeable, and said means for withdrawing air to provide a compacted layup comprising means producing a vacuum adjacent the bottom of said layup and an air-impermeable cover sheet covering the top of said layup.

* * * * *